United States Patent [19]

Würscher

[11] 4,247,213

[45] Jan. 27, 1981

[54] PLATEN FOR PRINTING DEVICES

[75] Inventor: Horst Würscher, Wilnsdorf, Fed. Rep. of Germany

[73] Assignee: U.S. Philips Corporation, New York, N.Y.

[21] Appl. No.: 792,646

[22] Filed: May 2, 1977

Related U.S. Application Data

[63] Continuation of Ser. No. 599,672, Jul. 28, 1975, abandoned.

[30] Foreign Application Priority Data

Aug. 3, 1974 [DE] Fed. Rep. of Germany ..... 2437454

[51] Int. Cl.³ ..... B41J 11/053

[52] U.S. Cl. ..... 400/661; 400/689

[58] Field of Search ..... 29/132; 100/295; 101/348, 375; 181/33 G, 33 J, 71; 197/144, 147

[56] References Cited

U.S. PATENT DOCUMENTS

| | | | |
|---|---|---|---|
| 503,534 | 8/1893 | Goff | 181/71 |
| 960,679 | 6/1910 | McLaughlin | 197/147 |
| 1,452,824 | 4/1923 | Bosworth | 197/147 |
| 1,693,533 | 11/1928 | Stickney | 197/147 |
| 1,721,385 | 7/1929 | Furnivall et al. | 181/71 |
| 3,057,450 | 10/1962 | Gallagher | 197/147 |
| 3,775,087 | 11/1973 | Ritter | 29/132 X |

*Primary Examiner*—Paul T. Sewell

*Attorney, Agent, or Firm*—Robert S. Smith

[57] ABSTRACT

A noise-reducing hollow platen having a hard external tube filled with steel or lead spheres.

6 Claims, 3 Drawing Figures

PLATEN FOR PRINTING DEVICES

This is a continuation of application Ser. No. 599,672, filed July 28, 1975, now abandoned.

BACKGROUND OF THE INVENTION

The invention relates to a hollow platen for printing devices in typewriters and booking machines, filled with sound-absorbing material.

The impact of the types of the printing device, such as type levers, type wheels or type parts, such as the printing needles in the case of screen printing, causes high-frequency vibrations in the platen, which is usually made of a very hard material. These vibrations create an extremely annoying noise which may eventually be health-hazardous, particularly when a number of printing devices are simultaneously in operation. Generally noise levels of from 70 dB to 80 dB are produced by such printing devices.

Because the impact of the type levers on the platen, being, for example, 15 kg force in the case of type levers and slightly less in the case of needle printing devices, cannot be substantially reduced, noise reduction can be realized substantially only by modifying the platen. To this end, it has already been proposed to secure the platen elastically or to provide it with a rubber jacket. However, a platen having a soft impact surface cannot be used, particularly in the case of needle printers, because the printing needles are liable to puncture and thus damage the record carrier.

It has also been attempted to reduce the impact noise by constructing the platen as a hollow body filled with a comparatively soft material. In known arrangements rubber, asbestos fibres, soft metals such as brass or aluminum, vulcanite, wood or resin were used as such a soft material. Either the complete platen consisted of the relevant material, or within a cylinder separate cylinders of the corresponding material were radially or axially arranged. It was found, however, that all these materials did not contribute to an effective noise reduction. Even a solid platen did not produce the desired effect.

SUMMARY OF THE INVENTION

The invention has for its object to minimize this impact noise. This object is achieved in that the material which is contained in the interior space of a hollow body and which absorbs the noise consists of small metal spheres having a high specific gravity.

Tests have revealed that the best noise reduction is achieved when use is made of steel or lead spheres having a diameter of from about 0.5 to 1.5 mm. Only about 60 dB was measured for a platen thus constructed.

Because the platen is made of a hard material, for example, steel, to avoid damage, each strike produces sound waves which propagate longitudinally along the surface. This effect notably occurs in the case of a platen constructed as a hollow cylinder. If such a hollow cylinder is filled with a material of the kind described above, even if this material is provided in granular form, the longitudinal waves will not be removed from the jacket surface of the cylinder so as to be destroyed. However, if small metal spheres having a high specific gravity are used as the absorbing material, the waves produced can be removed via a multitude of contact points in the interior of the cylinder, and can be partly converted into friction energy. It is not important that the spheres are made of a very hard material, but rather they should have a high specific gravity. It is particularly advantageous to use steel spheres. Even though lead is a comparatively soft material, it has a high specific gravity, so it is also suitable for obtaining the desired effect.

The invention will be described in detail hereinafter with reference to some embodiments according to the invention which are shown in the accompanying diagrammatic drawing.

Figure 1:
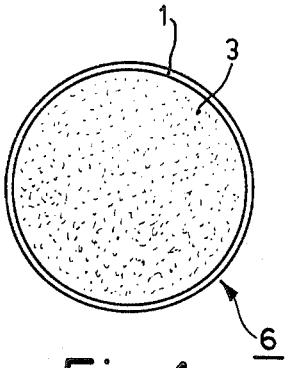
FIGS. 1 and 2 are sectional views of two embodiments of a platen according to the invention.

All details of a printing device which are not absolutely necessary for a proper understanding of the invention have been omitted in the drawing. They are not the subject of the invention and can be arbitrarily constructed in known manner. For the embodiments shown in the drawing, use is made of a platen commonly used in typewriters and booking machines. The platen is stationary, and the printing device is movable. The record carrier to be printed is guided around this platen and is step-wise advanced. The individual types perpendicularly strike the outer impact surface of the platen and can have a variety of shapes.

In most mechanical printing devices the types or typeparts used for printing alphanumeric characters strike the type roller. The impact is comparatively high. The invention does not relate to printing devices wherein the characters are not printed by impact, for example, static printers, ink-vapor printers or printers with roller impression.

The impact produces high-frequency vibrations in the roller-like platen which propagate mainly longitudinally in the hard material such as steel of the jacket 1 of the roller 6, thus causing the entire roller body 6 to vibrate. In order to reduce these vibrations, it is proposed to fill the interior space of the hollow body with steel or lead spheres 3. The high-frequency vibrations produced can thus propagate mainly radially in the interior of the hollow body 6. The longitudinal vibrations are then reduced. The large number of steel or lead spheres 3, completely filling the interior of the printing roller, absorb these radial vibrations, which are partly converted into friction energy. As a result, they can no longer produce sound vibrations.

Figure 2:
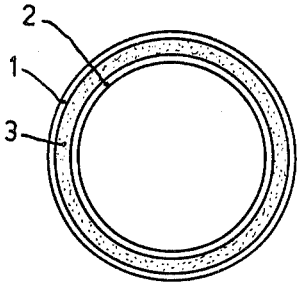
Figure 3:
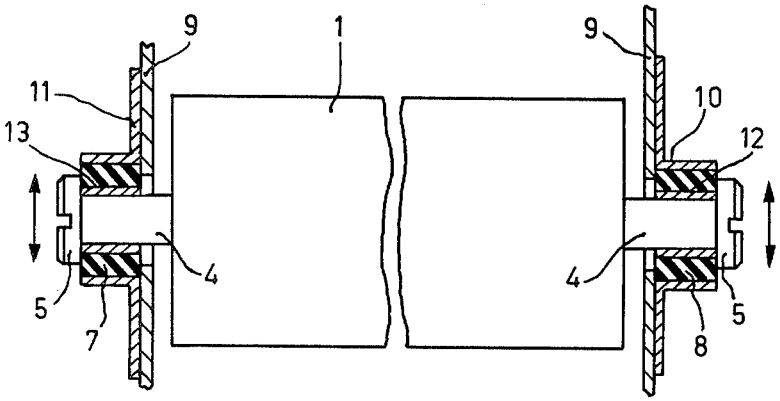
FIG. 3 is a side elevation of the platen.

Depending on the impact, these radial vibrations will propagate more or less deep into the interior of the roller 6. However, they will definitely not propagate as far as the center of the roller 6. This enables a second steel tube 2, as shown in FIG. 2, to be arranged concentrically inside the first jacket or tube 1, only the space formed between the two tubes then being filled with steel or lead spheres 3. The dimension of this space in the radial direction is determined by the impact of the types, and hence by the penetration of the vibrations produced by the impact.

A further reduction of the impact noise can be achieved by suspending the roller 6 to be rotatable in rubber grommets by way of the screws 4. The tube or jacket 1 is then laterally located by the two screwheads 5. The rubber grommets 7 and 8 contain a bearing sleeve 12, 13 of steel and are centrically located in the bearing wall 9 (not shown in detail) by way of the holding plates 10 and 11. The holding plates 10 and 11, together with the bearing sleeves 12 and 13 and the rubber grommets 7 and 8, are adjustable with respect to the bearing wall in the direction of the arrow in a manner not shown.

What is claimed is:

1. A hollow platen for impact printing devices, containing sound-absorbing material for reducing impact noise, wherein the absorbing material consists of a multiplicity of small metal spheres having a high specific gravity, said platen comprises a tube made of hard material and enclosing an interior space, said space being filled with said spheres.

2. A platen as claimed in claim 1 wherein said tube is made of steel, the outer impact surface of the platen being the surface of the steel.

3. A platen as claimed in claim 2 wherein the metal spheres are steel spheres.

4. A platen as claimed in claim 2 wherein the metal spheres are lead spheres.

5. A platan as claimed in claim 2 wherein the spheres have a diameter of from approximately 0.5 mm to 1.5 mm.

6. A platen as claimed in claim 1, comprising two concentric steel tubes arranged one inside the other, the interior space being an annular space between said tubes.

* * * * *